US006520094B2

(12) United States Patent
Wen

(10) Patent No.: US 6,520,094 B2
(45) Date of Patent: Feb. 18, 2003

(54) TABLE ASSEMBLY

(76) Inventor: Yong-Chang Wen, 3, San Yi Village, Da Bei Shian, Yun Lin Hsien (TW)

( * ) Notice: Subject to any disclaimer, the term of this patent is extended or adjusted under 35 U.S.C. 154(b) by 0 days.

(21) Appl. No.: 09/900,995

(22) Filed: Jul. 9, 2001

(65) Prior Publication Data

US 2003/0005864 A1 Jan. 9, 2003

(51) Int. Cl.[7] ..... A47B 3/00
(52) U.S. Cl. ..... 108/132; 108/157.16
(58) Field of Search ..... 108/115, 129, 108/130, 131, 132, 157.16, 158.12, 157.1, 158.13, 159.11; 403/386, 388, DIG. 11; 248/439

(56) References Cited

U.S. PATENT DOCUMENTS

| | | | | | |
|---|---|---|---|---|---|
| 2,474,450 | A | * | 6/1949 | Woodruff | 108/132 |
| 2,670,031 | A | | 2/1954 | Melges | |
| 2,756,082 | A | * | 7/1956 | Pucci | 108/131 |
| 2,805,708 | A | | 9/1957 | Bohn | |
| 2,831,688 | A | | 4/1958 | Knox | |
| 3,353,867 | A | | 11/1967 | Anderson | |
| 3,765,719 | A | | 10/1973 | Silver | |
| 3,905,478 | A | | 9/1975 | Peterson | |
| 4,497,093 | A | * | 2/1985 | Haberkorn | 108/159 |
| 4,579,473 | A | * | 4/1986 | Brugger | 403/DIG. 11 |
| 4,740,032 | A | | 4/1988 | Olsen et al. | |
| 4,834,450 | A | | 5/1989 | Stickler | |
| 4,998,395 | A | | 3/1991 | Bezner | |
| 5,070,664 | A | | 12/1991 | Groh et al. | |
| 5,141,197 | A | * | 8/1992 | Mackaay | 248/439 |
| 5,357,872 | A | * | 10/1994 | Wilmore | 108/132 |
| 5,536,552 | A | | 7/1996 | Scripsick | |
| 5,729,948 | A | * | 3/1998 | Levy et al. | 403/388 |
| 5,983,807 | A | * | 11/1999 | Tarnay et al. | 108/131 |
| 6,112,674 | A | * | 9/2000 | Stanford | 108/129 |
| 6,371,034 | B1 | * | 4/2002 | Simpson et al. | 108/129 |

FOREIGN PATENT DOCUMENTS

| | | | |
|---|---|---|---|
| DE | 3827827 | * | 2/1990 |
| FR | 2686003 | * | 7/1993 |

* cited by examiner

*Primary Examiner*—Lanna Mai
*Assistant Examiner*—Hanh V. Tran
(74) *Attorney, Agent, or Firm*—Alan Kamrath; Rider, Bennett, Egan & Arundel, LLP

(57) ABSTRACT

A table assembly has a table plate, a pair of leg devices, and a plurality of fastening clamps. The table plate has two pairs of spaced recesses, and a plurality of grooves. Each leg device has a U-shaped rod, two posts, two first link bars, two second link bars, and two support plates. Each support plate is inserted into the corresponding recess, and is formed with two oblong holes aligned with the corresponding grooves Each of the fastening clamps has an oblong plate and two arm plates. The arm plates are extended through the corresponding oblong holes of the support plates and are inserted into the corresponding grooves of the table plate.

3 Claims, 7 Drawing Sheets

TABLE ASSEMBLY

BACKGROUND OF THE INVENTION

The present invention relates to a table assembly. More particularly, the present invention relates to a table assembly which is assembled easily.

A conventional table has four legs to be fastened by screws. It is difficult to detach the legs from the conventional table.

SUMMARY OF THE INVENTION

An object of the present invention is to provide a table assembly which which is assembled easily.

Another object of the present invention is to provide a table assembly which which is detached easily.

Accordingly, a table assembly comprises a table plate, a pair of leg devices, and a plurality of fastening clamps. The table plate has a bottom formed with two pairs of spaced recesses, and a plurality of grooves communicating with the spaced recesses. Each of the leg devices has a U-shaped rod, two posts each mounted on a bottom of the U-shaped rod, two first link bars each mounted on a respective one of the posts, two second link bars each connected to a respective one of the first link bars, and two support plates, one of the two support plates being mounted on the second link bars and the other one of the two support plates being mounted on the two posts. Each of the support plates is inserted into the corresponding recess of the table plate, and is formed with two oblong holes aligned with the corresponding grooves of the table plate. Each of the fastening clamps has an oblong plate and two arm plates each mounted on a bottom of the oblong plate. The arm plates of each of the fastening clamps are extended through the corresponding oblong holes of the support plates and are inserted into the corresponding grooves of the table plate.

DETAILED DESCRIPTION OF THE INVENTION

Figure 1:
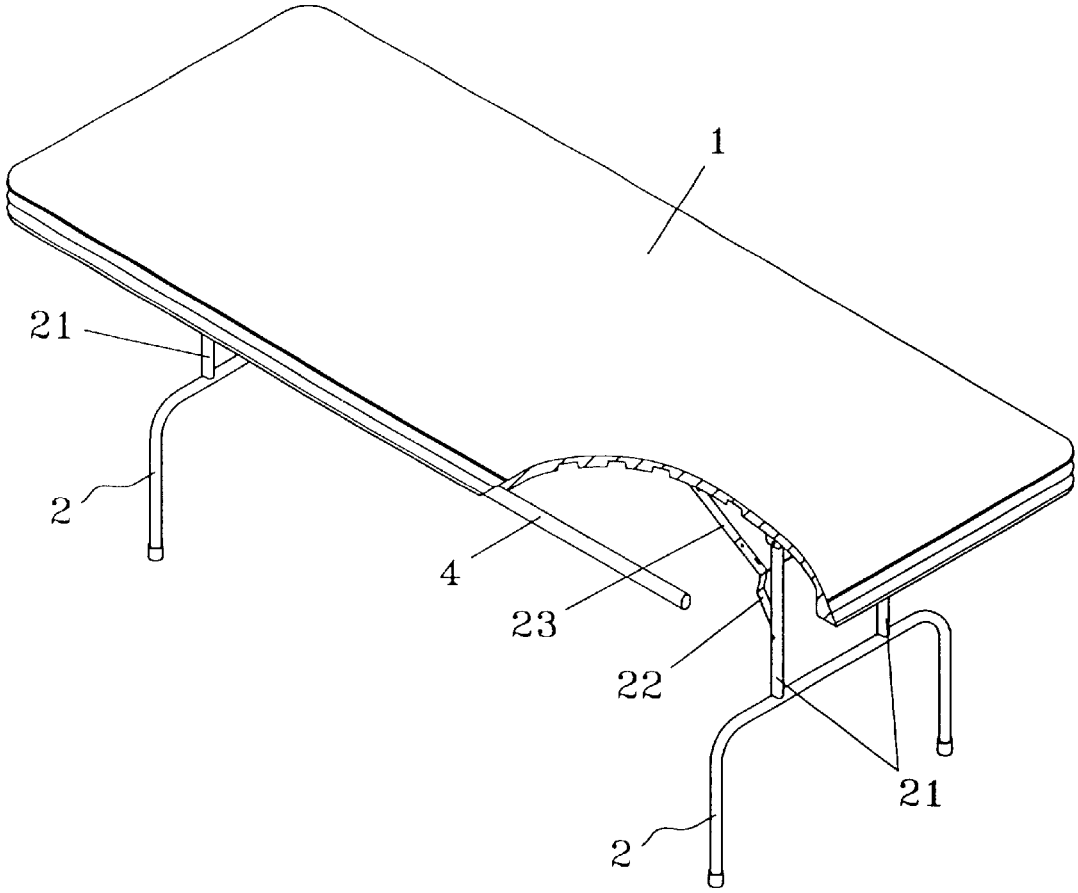
FIG. 1 is a perspective assembly view of a table assembly of a preferred embodiment in accordance with the present invention.
Figure 2:
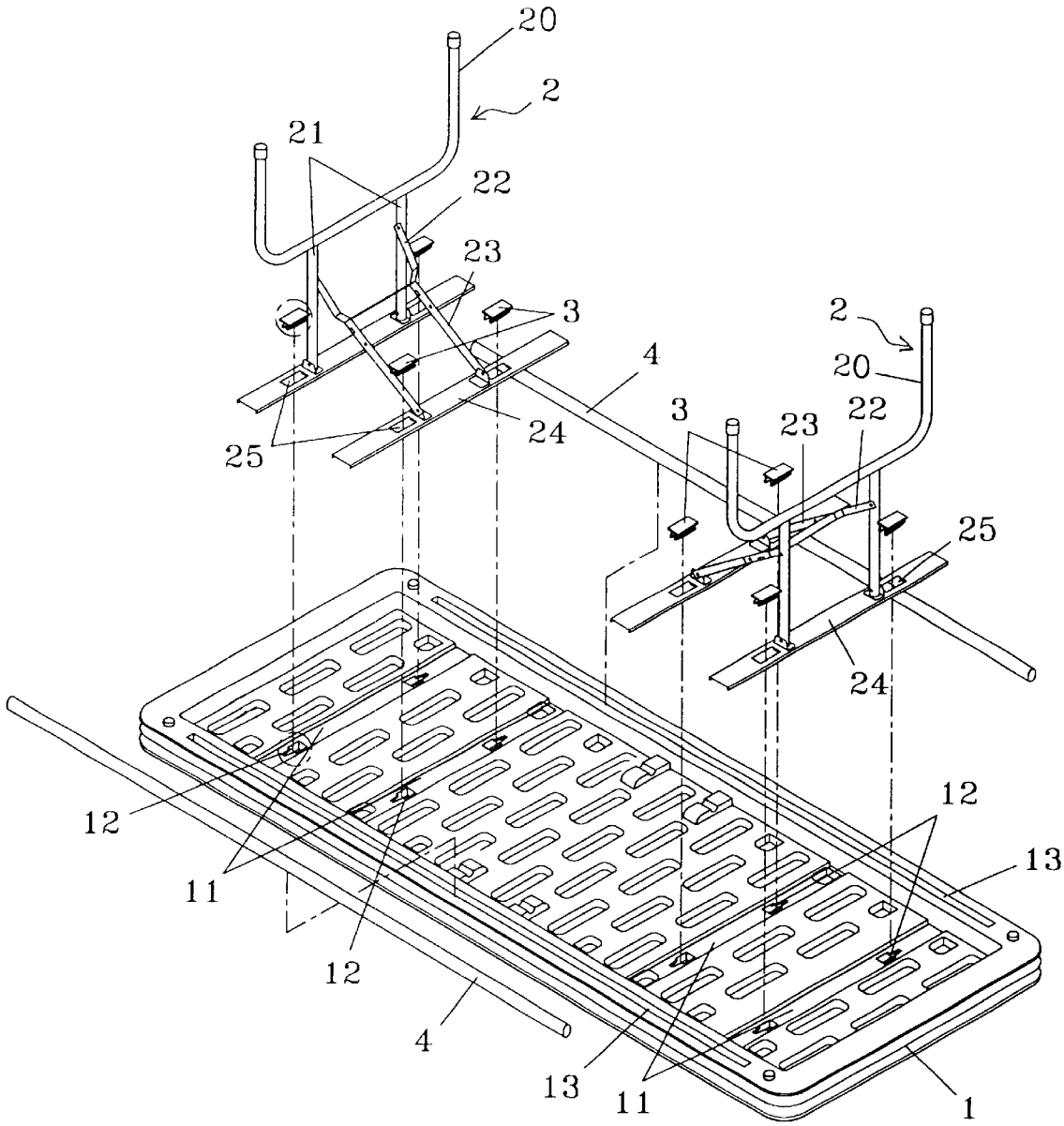
FIG. 2 is a perspective exploded view of a table assembly of a preferred embodiment in accordance with the present invention.
Figure 2A:
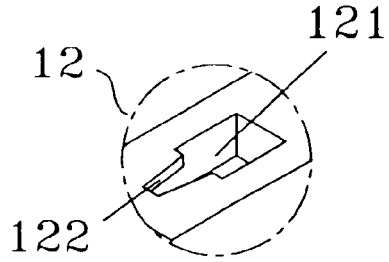
FIG. 2A is an enlarged view of a groove of a table assembly of a preferred embodiment in accordance with the present invention.
Figure 2B:
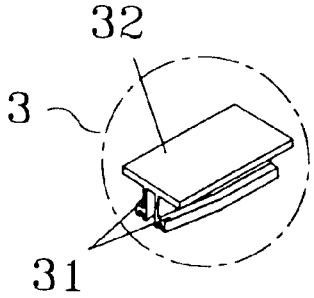
FIG. 2B is a perspective view of a fastening clamp of a preferred embodiment in accordance with the present invention.
Figure 3:
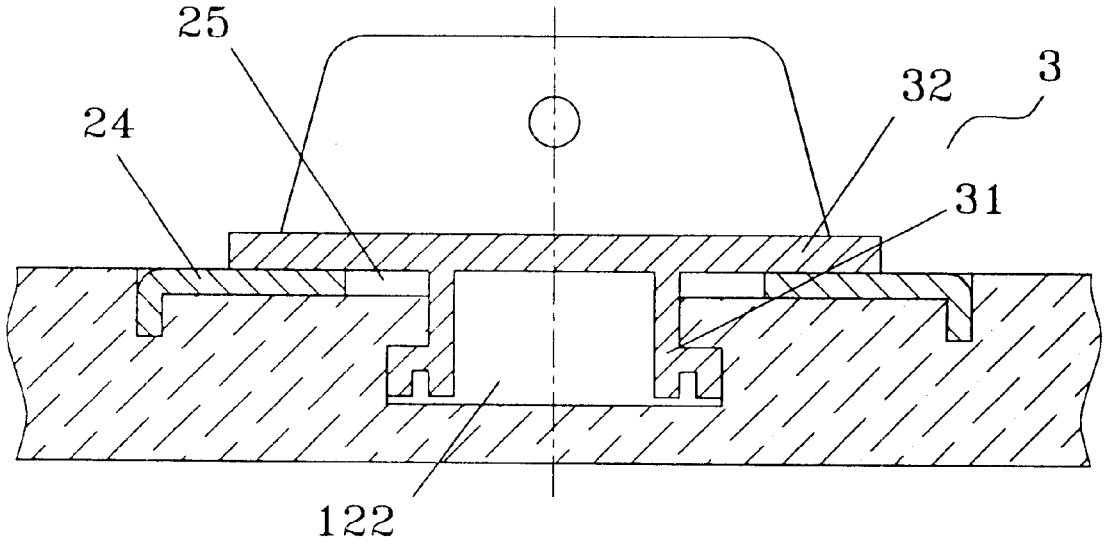
FIG. 3 is a partially sectional assembly view of a table assembly of a preferred embodiment in accordance with the present invention.
Figure 4:
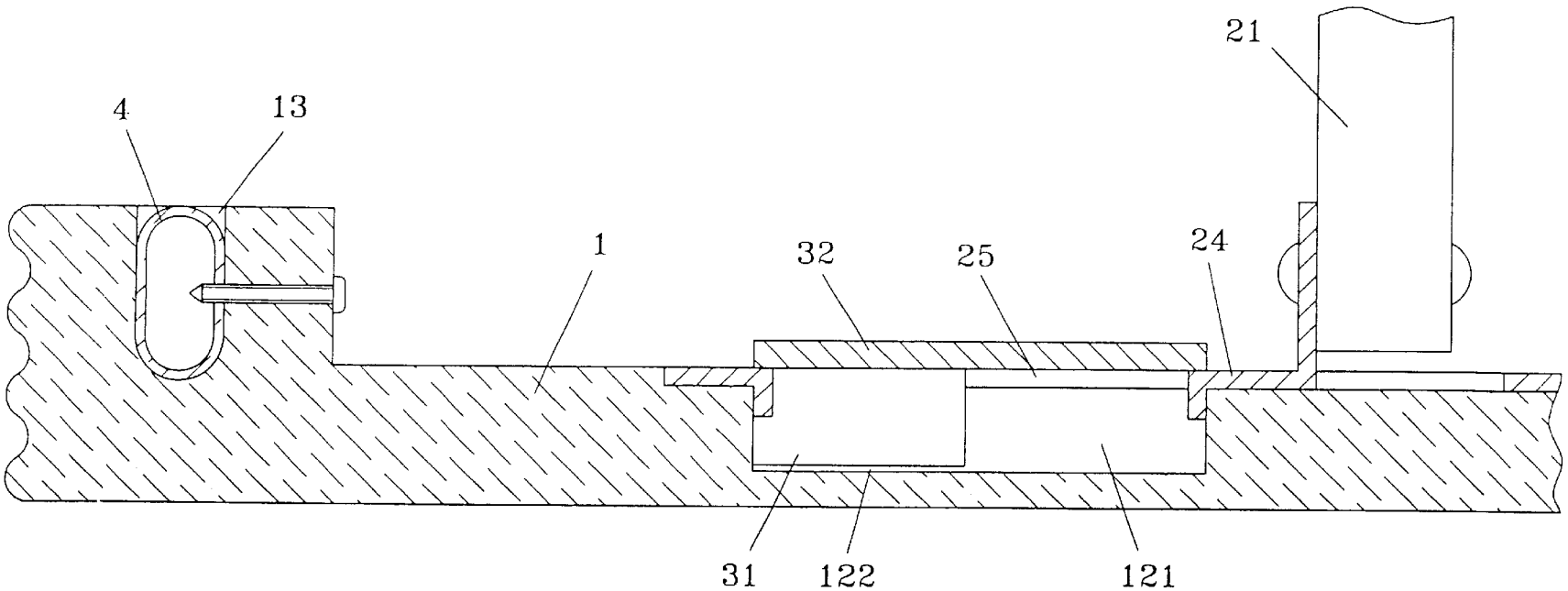
FIG. 4 is a sectional assembly view of a table assembly of a preferred embodiment in accordance with the present invention.
Figure 5:
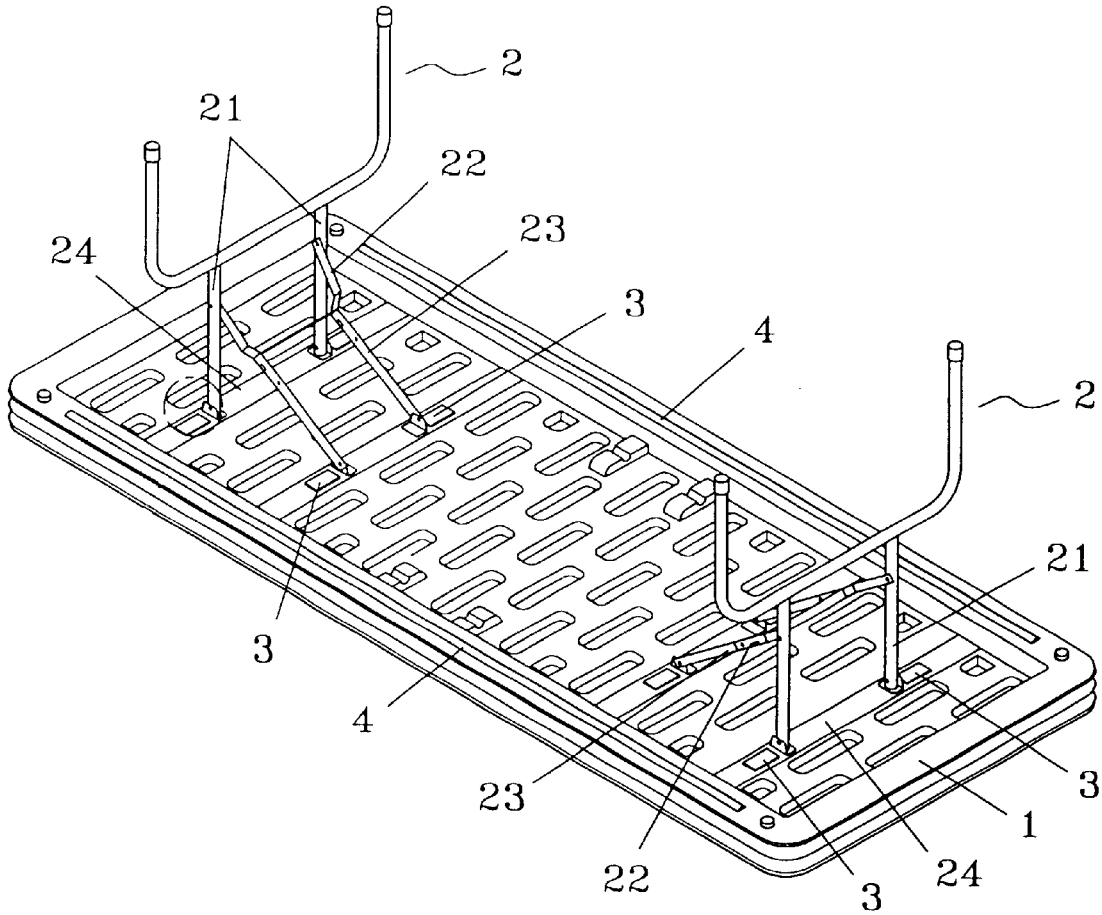
FIG. 5 is another perspective assembly view of a table assembly of a preferred embodiment in accordance with the present invention.
Figure 5A:
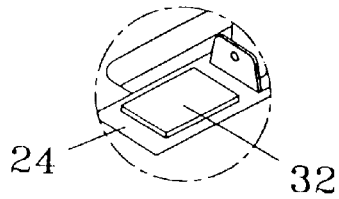
FIG. 5A is a perspective assembly view of a fastening clamp and a support plate of a preferred embodiment in accordance with the present invention.

Referring to FIGS. 1 to 5, a table assembly comprises a table plate 1, a plurality of fastening clamps 3, and a pair of leg devices 2.

The table plate 1 has two pairs of spaced recesses 11, a plurality of grooves 12 communicating with the spaced recesses 11, and two channels 13.

Each of the fastening clamps 3 has an oblong plate 32 and two arm plates 31 connected to the oblong plate 32.

Each of the leg devices 2 has a U-shaped rod 20, two posts 21 disposed on the U-shaped rod 20, two first link bars 22 disposed on the posts 21, two second link bars 23 connected to the first link bars 22, and two support plates 24 disposed on the second link bars 23.

Each of the support plates 24 is formed with two oblong holes 25 aligned with the corresponding grooves 12 of the table plate.

Each of the support plates 24 is inserted in the corresponding spaced recesses 11.

The arm plates 31 of each of the fastening clamps 3 is inserted through the corresponding oblong holes 25 and inserted in the corresponding grooves 12.

Each of the grooves 12 has a taper end 122 and an enlarged end 121.

Two reinforced rods 4 are inserted in the channels 13.

Figure 6:
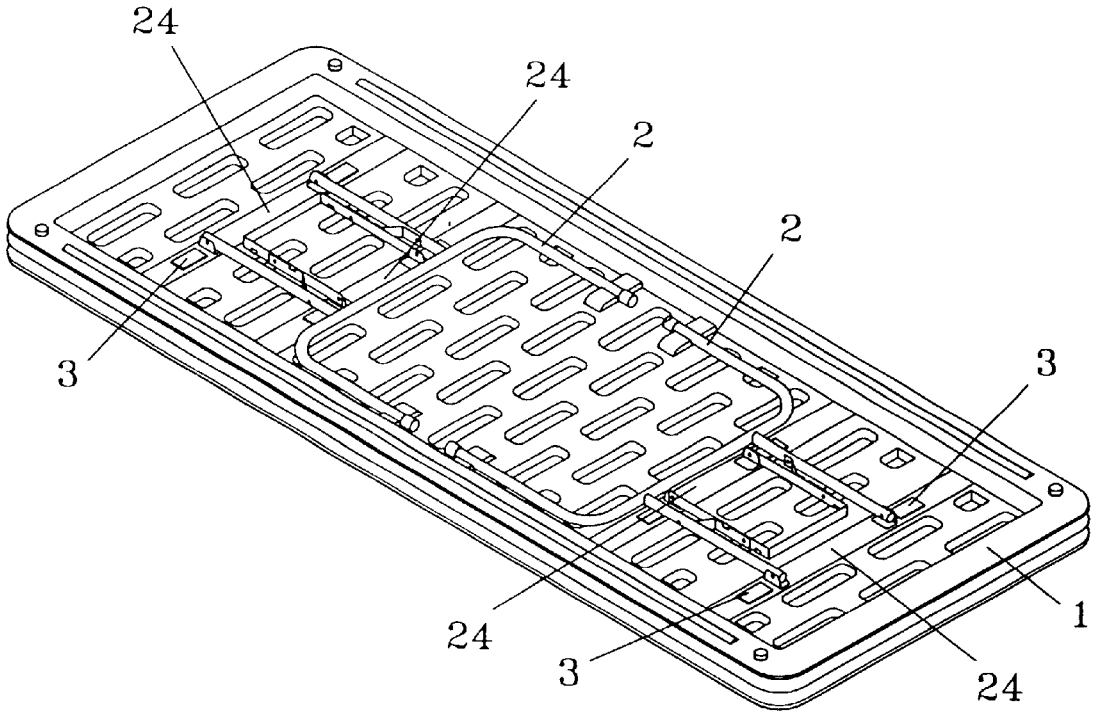
FIG. 6 is a schematic view illustrating a pair of leg devices are folded.

Referring to FIG. 6, the leg devices 2 are folded.

The invention is not limited to the above embodiment but various modification thereof may be made. Further, various changes in form and detail may be made without departing from the scope of the invention.

I claim:

1. A table assembly comprising:

a table plate, a pair of leg devices, and a plurality of fastening clamps, wherein:

the table plate has a bottom formed with two pairs of spaced recesses, and a plurality of grooves communicating with the spaced recesses, each of the leg devices has a U-shaped rod, two posts each mounted on a bottom of the U-shaped rod, two first link bars each mounted on a respective one of the posts, two second link bars each connected to a respective one of the first link bars, and two support plates, one of the two support plates being mounted on the second link bars and the other one of the two support plates being mounted on the two posts, each of the support plates is inserted into the corresponding recess of the table plate, and is formed with two oblong holes aligned with the corresponding grooves of the table plate, and each of the fastening clamps has an oblong plate and two arm plates each mounted on a bottom of the oblong plate, the arm plates of each of the fastening clamps are extended through tee corresponding oblong holes of the support plates and are inserted into the corresponding grooves of the table plate.

2. The table assembly as claimed in claim 1, wherein the table plate has two channels, and the table assembly further comprises two reinforced rods each inserted into a respective one of the channels.

3. The table assembly as claimed in claim 1, wherein each of the grooves of the table plate has a taper end and en enlarged end, and each of the arm plates of each of the fastening clamps has a taper portion rested on the taper end of the corresponding groove of the table plate and an enlarged portion rested on the enlarged end of the corresponding groove of the table plate.

* * * * *